US008636279B2

(12) United States Patent
Suzuki et al.

(10) Patent No.: US 8,636,279 B2
(45) Date of Patent: Jan. 28, 2014

(54) PAPER SUPPLY APPARATUS

(75) Inventors: Norihiro Suzuki, Kahoku (JP); Masayoshi Kawai, Uchinada-machi (JP)

(73) Assignee: PFU Limited, Ishikawa (JP)

( * ) Notice: Subject to any disclaimer, the term of this patent is extended or adjusted under 35 U.S.C. 154(b) by 1346 days.

(21) Appl. No.: 10/575,230

(22) PCT Filed: Dec. 2, 2004

(86) PCT No.: PCT/JP2004/017920

§ 371 (c)(1),
(2), (4) Date: Apr. 7, 2006

(87) PCT Pub. No.: WO2005/056445

PCT Pub. Date: Jun. 23, 2005

(65) Prior Publication Data

US 2007/0080492 A1 Apr. 12, 2007

(30) Foreign Application Priority Data

Dec. 15, 2003 (JP) ..... 2003-416528

(51) Int. Cl.
*B65H 1/06* (2006.01)

(52) U.S. Cl.
USPC ..... 271/165; 271/10.02; 271/4.02

(58) Field of Classification Search
USPC ..... 271/4.02, 10.02, 136, 165
See application file for complete search history.

(56) References Cited

U.S. PATENT DOCUMENTS 3,790,163 A * 2/1974 Helm ..... 271/165
3,961,785 A * 6/1976 Gall ..... 271/119
4,607,832 A * 8/1986 Abe ..... 271/10.08
4,653,742 A 3/1987 Sasaki et al.
4,715,593 A * 12/1987 Godlewski ..... 271/10.11
5,755,434 A * 5/1998 Takatoshi et al. ..... 271/3.05
5,906,366 A 5/1999 Chang
5,939,646 A * 8/1999 Fowler ..... 73/862.193
6,247,693 B1 * 6/2001 Kawano ..... 271/3.05

FOREIGN PATENT DOCUMENTS

| | | |
|---|---|---|
| JP | 4-348360 | 12/1992 |
| JP | 6-9110 | 1/1994 |
| JP | 06-009110 | 1/1994 |
| JP | 2000-339510 | 12/2000 |
| JP | 2002-308448 | 10/2002 |

OTHER PUBLICATIONS

International Preliminary Report on Patentability, mailed on Aug. 3, 2006, for corresponding PCT Patent Application.
Supplemental European Search Report, mailed Mar. 31, 2008.

* cited by examiner

*Primary Examiner* — Michael C McCullough
*Assistant Examiner* — Howard Sanders
(74) *Attorney, Agent, or Firm* — Staas & Halsey LLP

(57) ABSTRACT

This invention provides a bottom removal-type paper supply apparatus used in an image reading apparatus or the like which can always accurately supply paper into the image reading apparatus regardless of whether the amount of paper stacked on a paper support base is small or large. In order to transport paper stacked on the paper support base into the apparatus, a first pickup roller to which a pressing force can be applied by a pressing roller and a second pickup roller at a central portion of the paper support base which assists the first pickup roller are provided. The second pickup roller is provided with a shutter. By closing the shutter when the paper stacked on the paper support base is less than or equal to a prescribed number of sheets or weight, the pickup roller and the paper can be prevented from contacting.

7 Claims, 8 Drawing Sheets

CASE WHERE NO LOAD IS APPLIED TO SHUTTER

CASE WHERE LOAD IS APPLIED TO SHUTTER

SIDE VIEW

TOP VIEW

CASE WHERE AMOUNT OF PAPER IS SMALL

CASE WHERE AMOUNT OF PAPER IS LARGE

PAPER SUPPLY APPARATUS

This application claims the benefit of PCT International Application Number PCT/JP2004/017920 filed Dec. 2, 2004 and Japanese Application No. 2003-416528, filed Dec. 15, 2003 in Japan, the disclosures of which are incorporated herein by reference.

TECHNICAL FIELD

This invention relates to a bottom removal-type paper supply apparatus used primarily in an image reading apparatus such as a scanner. This invention realizes a paper supply apparatus which makes it possible to accurately supply paper one sheet at a time from the very bottom of a stack of paper without the occurrence of misfeeds regardless of the amount of paper stacked on a paper support base.

BACKGROUND ART

In many cases, an automatic paper supply apparatus used in an image reading apparatus is designed to supply an original to the image reading apparatus such that the side of the original which is to be read faces downwards, because of the manner of mounting of an optical image reading mechanism, such as a CCD, onto the body of the image reading apparatus. A bottom removal-type paper supply apparatus is used since it has the advantage that origins are stacked in the order in which the originals are placed.

A paper supply apparatus used in a typical image reading apparatus has a structure like that shown in FIG. 9. When there are a plurality of sheets of originals to be read, the plurality of sheets of paper 55 are stacked up, and they are set on a paper support base 56 so that the ends of the paper 55 ride atop a pickup roller 50. Due to the rotation of the pickup roller 50 so as to draw the paper 55 which was set into the apparatus, the bottom sheet of paper 55 is picked by the frictional force acting on the portion contacted by the pickup roller 50 and it is transported into the body of the apparatus. At this time, there are cases in which not just the bottom sheet but a number of sheets above it are also transported. However, the thickness of sheets which can pass is regulated by a paper supply gate 52, so the number of sheets which can be supplied to the apparatus is reduced, and only one sheet of paper is supplied into the apparatus by a separator roller 53 and a brake roller 54.

In this type of paper supply apparatus, in order to transport the paper 55 into the apparatus with certainty, it is necessary for the frictional force which acts in the contact region between the bottom sheet of the stacked paper 55 and the pickup roller 50 to be sufficiently larger than the frictional force acting between the paper 55 and the paper support base 56 or the frictional force acting between sheets of paper. The size of the frictional force acting in the contact region between the paper 55 and the pickup roller 50 is proportional to the coefficient of friction between the paper 55 and the pickup roller 50 and to the force with which the paper 55 is pressed against the pickup roller 50. Accordingly, in order to make the frictional force acting in the contact region between the paper 55 and the pickup roller 50 sufficiently large, it is effective to increase the coefficient of friction of the pickup roller 50 or to increase the force with which the paper 55 is pressed against the pickup roller 50.

If the force with which the paper 55 is pressed against the pickup roller 50 depends on the weight of the paper itself, when the number of stacked sheets is small, a sufficient frictional force can no longer be obtained, so a pressing roller 51 is provided which exerts a force pressing the paper towards the pickup roller 50. In order to increase the frictional force acting in the contact region between the paper 55 and the pickup roller 50, the pressure applied by the pressing roller 51 is increased, and thus, a sufficiently large frictional force is obtained.

However, if the pressure applied by the pressing roller 51 is made too large a value, the frictional force acting between sheets of paper also ends up being large, and there are cases in which it becomes the cause of paper misfeeds such as double feeds in which a plurality of sheets of paper are transported into the apparatus at the same time. Therefore, in a paper supply apparatus like that shown in FIG. 9, the pressure applied by the pressing roller 51 is restrained to at most a prescribed level at which double feeds and the like do not take place.

No problems occur when a small amount of paper 55 is stacked on the paper support base 56. However, when a large amount of paper 55 is stacked, the pressing force acting on the bottom sheet of paper 55 due to the weight of the stacked paper becomes large, and the frictional force acting between the paper 55 and the paper support base 56 and the frictional force acting between sheets of paper becomes too large, and there was the problem that the bottom sheet of paper 55 could not be transported into the apparatus given the frictional force acting in the contact region between the paper 55 and the pickup roller 50.

In order to solve the problem of the occurrence of misfeeds when a large amount of paper is stacked on a paper support base in this manner, as shown in FIG. 10, a paper supply apparatus which has a second pickup roller 57 which is a separate, additional pickup roller at a central portion of the paper support base 56 has been conceived (see, for example, Patent Document 1). In a paper supply apparatus having a second pickup roller 57 in this manner, when the amount of stacked paper becomes large, the force with which the bottom sheet of paper 55 is pressed against the second pickup roller 57 also increases due to the weight of the paper stacked on the bottom sheet of paper 55, so the frictional force acting in the contact region between the paper 55 and the second pickup roller 57 also increases. As a result, when the second pickup roller 57 is rotatably driven, a force acts so as to convey the paper 55 into the apparatus. This assists the conveying force acting between the paper 55 and the pickup roller 50, and the paper 55 can be transported into the apparatus.

However, in a paper supply apparatus having such a second pickup roller, although it works effectively when a large amount of paper is stacked as shown in FIG. 11(B), when the stacked amount is small, due to a difference between the coefficients of friction of the first pickup roller and the second pickup roller and other factors, a difference in transportation amount is produced between the first pickup roller and the second pickup roller, and in some cases, as shown in FIG. 11(A), the paper ends up bending and paper misfeeds occur.

Patent Document 1: Japanese Patent Application Laid-Open (kokai) No. 2002-308448

DISCLOSURE OF THE INVENTION

Problem to be Solved by the Invention

As described above, in the case where a pressing roller is provided in a bottom removal-type paper supply apparatus so as to obtain a sufficient transport force, when a large amount of paper is stacked on a paper support base, the frictional force between the paper and the paper support base and the frictional force between sheets becomes too large, and there is the problem that paper can not be transported into the apparatus by the pickup roller. This problem can be solved by providing a second pickup roller at a central portion of the paper support base and supplementing the transporting force of the first pickup roller with the transporting force of the second pickup roller. As a result, even when a large amount of paper is stacked on a paper support base, paper can be accurately supplied into the apparatus without misfeeds.

However, in a paper supply apparatus having such a second pickup roller, when the amount of paper stacked on the paper support base is small, due to a difference between the coefficients of friction of the first pickup roller and the second pickup roller and other factors, a difference in paper transportation amount is produced between the first pickup roller and the second pickup roller, and in some cases, paper bends-during paper transport and paper misfeeds occur.

Accordingly, the object of the present invention is to solve the above-described problem and to provide a bottom removal-type paper supply apparatus used in an image reading apparatus or the like which can always accurately supply paper into the image reading apparatus whether the amount of paper stacked on the paper support base is large or small.

Means for Solving the Problem

A bottom removal-type paper supply apparatus according to the present invention has a pressure applying means which presses against paper stacked on a paper support base, a first pickup roller which picks a sheet from the bottom of paper stacked on a paper support base and transports it into the apparatus and which is provided at the end of the paper support base closest to the body of the imagine reading apparatus or the like, and a second pickup roller which assists the first pickup roller and transports stacked paper into the apparatus and is provided at a central portion of the paper support base. The second pickup roller has a shutter which can be switched between an open state in which the stacked paper can come into contact with the second pickup roller and a closed state in which the shutter prevents the contact. The shutter is opened so as to utilize the paper transport force of the second pickup roller only when the sheets stacked on the paper support base exceed a prescribed weight or a prescribed-number.

The opening and closing of the shutter may be performed by sensing the weight of paper stacked on the paper support and controlling the shutter to open the shutter when the sensed weight is at least a prescribed weight and close the shutter when the weight of paper is less than or equal to the prescribed weight.

The opening and closing of the shutter may be performed by sensing, by use of a paper transport sensor, that the first pickup roller has failed to pick a sheet with resultant occurrence of a paper misfeed, and opening the shutter for the second pickup roller when the paper supply by only the first pickup roller fails.

Effects of the Invention

According to the present invention, when the amount of paper-stacked on the paper support base of the bottom removal-type paper supply apparatus is small, supply of paper is carried out only by the first pickup roller, and the second pickup roller is operated only when the amount of paper is large and paper supply cannot be performed by the first-pickup roller. Therefore, it is possible to provide a bottom removal-type paper supply apparatus in which paper misfeeds do not occur.

Although the second pickup roller is provided at a central portion of the paper support base, when the apparatus is not being used, the shutter is closed and adhesion of dirt can be prevented. In addition, when paper is being set on the paper support base, the danger of a hand being pulled in by a projecting pickup roller can be prevented.

DESCRIPTION OF SYMBOLS

Figure 1:
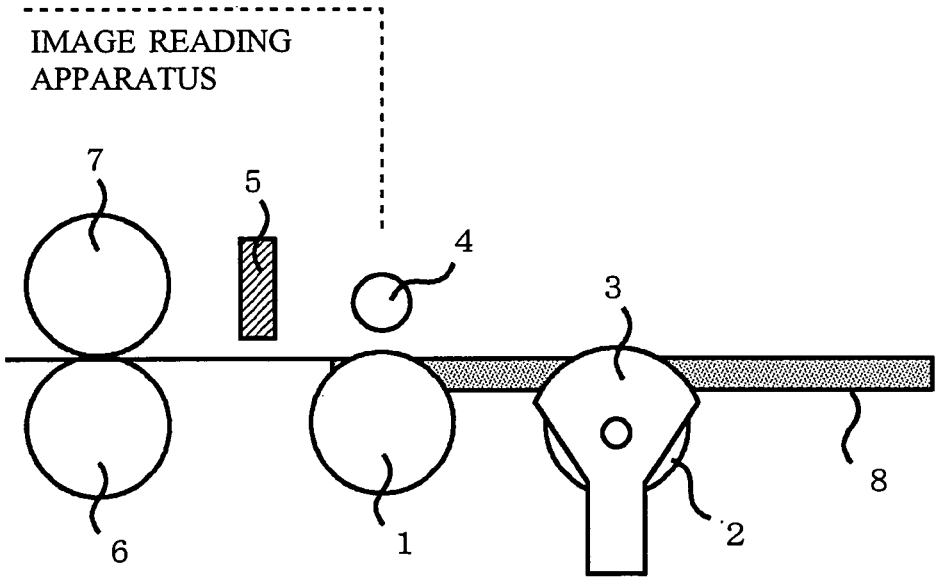
FIG. 1 is an overall view of the structure of the present invention.

1: first pickup roller
2: second pickup roller
3: shutter
4: pressing roller
5: paper supply gate
6: separator roller
7: brake roller
8: paper support base
9: stepping motor for driving the pickup arm
10: pickup arm
11: paper
12: paper transport sensor
13: tension spring
14: stopper
15: shutter hook
16: roller drive system hook
17: drive shaft for the second pickup roller
18: torque limiter
19: belt
20: stepping motor for opening and closing the shutter
21: roller shaft
31, 32: engagement hole

BEST MODE FOR CARRYING OUT THE INVENTION

Below, the present invention will be explained based on examples. FIG. 1 is a view illustrating a bottom removal-type paper supply apparatus used in an image reading apparatus or the like. A first pickup roller 1 is provided at the end of a paper support base 8. It picks paper stacked on the paper support base 8 from the bottom and transports it into the apparatus. At this time, there are cases in which it transports not only the bottom sheet but simultaneously transports several sheets above it. However, the thickness of sheets which can pass is regulated by a paper supply gate 5, so the number of sheets which are supplied into the apparatus is reduced. Only one sheet of paper is fed into the apparatus by a separator roller 6 and a brake roller 7. A pressing roller 4 is constituted so that the pressure with which the paper is pressed against the first pickup roller can be adjusted. As a result, paper stacked on the paper support base 8 can be transported into the apparatus in sequence from the bottom, and by suitably adjusting the pressure applied by the pressing roller 4, frequent occurrence of pickup misses due to an inadequate pressing force or occurrence of double feeds due to an excessive pressing force can be prevented.

At a central portion of the paper support base 8, a second pickup roller 2 which assists the first pickup roller and transports stacked paper into the apparatus is provided. When a large amount of paper is stacked on the paper support base 8, the paper cannot be picked only by the first pickup roller 1 and paper misfeeds occur. Even in such a case, by utilizing the paper transport force of the second pickup roller 2, paper supply can always be carried out in sequence from the bottom of paper stacked on the paper support base 8.

The second pickup roller 2 is equipped with a shutter 3. Its structure is such that when the paper transport force of the second pickup roller 2 is not needed, the shutter 3 is closed, the second pickup roller 2 is housed therein, and contact between the second pickup roller and the paper is prevented. As a result, in cases such as when only a small amount of paper is stacked on the paper support base 8, deformation of paper and paper misfeeds due to the development of a difference in paper transportation amount due, for example, to a difference between the coefficients of friction of the first pickup roller 1 and the second pickup roller 2 can be prevented. Opening and closing of the shutter provided on the second pickup roller 2 can be carried out based on the weight or the number of sheets of paper stacked on the paper support base 8. The paper supply apparatus is configured such that the shutter is opened when it is detected that the amount of paper is at least a prescribed weight or number of sheets, and such that the shutter is closed when the amount is less than or equal to the prescribed weight or number of sheets. As a result, the shutter 3 is opened and the transport force of the second pickup roller 2 can be utilized only when a large amount of paper is stacked on the paper support base, and the shutter 3 is closed and contact between the second pickup roller 2 and the paper is prevented when a small amount of paper is stacked on the paper support base.

Opening and closing of the shutter 3 provided on the second pickup roller 2 can be carried out by sensing the occurrence of a pickup miss by the first pickup roller 1. The shutter 3 is opened when the occurrence of a pickup miss is sensed by a paper transport sensor or the like. The shutter 3 is closed when it is sensed by the paper transport sensor or the like that the transport of paper has been carried out in a normal manner. As a result, a situation in which a paper misfeed is occurring under only the transport force of the first pickup roller 1 can be reliably detected, the second pickup roller 2 can be utilized, and stable paper supply operation can be always carried out regardless of the stacked condition of paper on the paper support base 8.

Operation of the Pressing Roller

Figure 2:
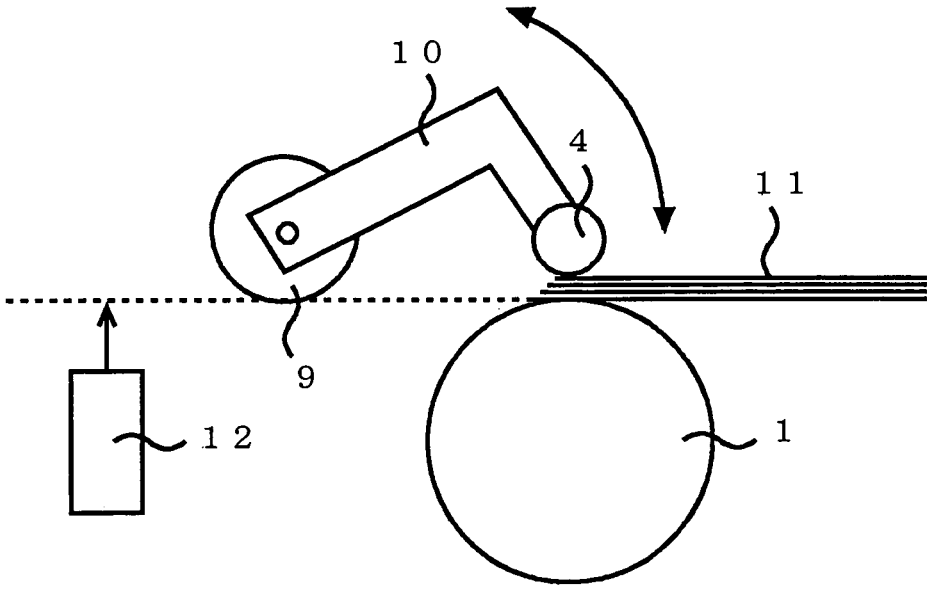
FIG. 2 is an explanatory view of the pickup arm.

As shown in FIG. 1, the first pickup roller 1 has a pressing roller 4 which can apply an adjustable force and which is provided at the end of the paper support base 8 on the-side closest to the apparatus body. FIG. 2 is a view explaining the operation of this pressing roller 4. The pressing roller 4, which can apply an adjustable force, is mounted on a pickup arm 10, the amount of driving of which can be adjusted by a stepping motor 9 for driving the pickup arm. By rotatably driving the pickup arm 10, the force with which the paper 11 is pressed against the first pickup roller 1 can be adjusted by the pressing roller 4 mounted on the distal end of the pickup arm 10.

To control the pressure applied by this pressing roller 4, a prescribed pressing force is set as a default value, and at the start of paper supply, the paper 11 is pressed by the pressing roller 4 against the first pickup roller 1 with this default pressing force. When the first pickup roller 1 fails to-pick a sheet with this pressing force, the stepping motor 9 for driving the pickup arm is controlled, and by rotatably driving the pickup arm 10 by a prescribed amount in the direction pressing the paper, the pressing force applied by the pressing roller 4 is controlled so as to increase by the prescribed amount. If the first pickup roller 1 still fails to pick a sheet, in the same manner as described above, the pressing force is controlled so as to increase by the prescribed amount. This processing in which the pressing force is increased by the prescribed amount is repeated until a sheet 11 is successfully picked, and when pickup is successful, in preparation for pickup of the next sheet, the stepping motor 9 for driving the pickup arm is controlled, the pickup arm 10 is rotatably driven in the reverse direction, and the pressing force applied by the pressing roller 4 is controlled so as to become the default pressing force.

By controlling the pressing force by the pressing roller 4 in this manner, the pressing force is increased when necessary by just the necessary amount, so paper pickup by the first pickup roller 1 is carried out with certainty, and when pickup is being stably carried out, the pressing roller 4 is prevented as much as possible from unnecessarily applying an excessive pressing force, and the occurrence of misfeeds such as double feeds can be suppressed.

Determination of whether paper pickup by the first pickup roller 1 has successfully taken place is carried out by sensing whether a sheet has been transported using a paper transport sensor 12 provided on the sheet transport path, as shown in FIG. 2. By applying a pressing force in this manner with the pressing roller 4, the paper pickup operation by the first pickup roller 1 is carried out with certainty. However, if this pressing force becomes too great, it increases the frictional force between sheets, and it becomes a cause of paper misfeeds such as double feeds, so a pressing force above a prescribed value cannot be applied.

Therefore, when a large amount of paper is stacked on the paper support base, a situation develops in which the frictional force between the bottom stacked sheet and the paper support base or the frictional force between sheets becomes too large, and pickup cannot be performed with just the first pickup roller 1 to which pressure is applied by the pressing roller 4. In this apparatus, for such a situation, as shown in FIG. 1, the second pickup roller 2 equipped with the shutter 3 is provided at a central portion of the paper support base.

Figure 3:
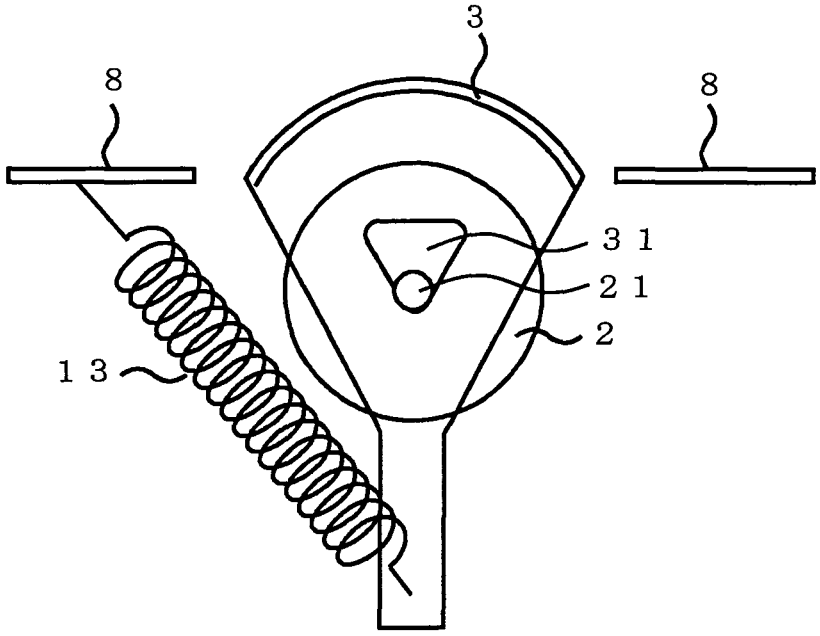
FIG. 3 is an explanatory view showing a state in which a first example of a shutter which opens and closes under the weight of stacked paper is closed.
Figure 4:
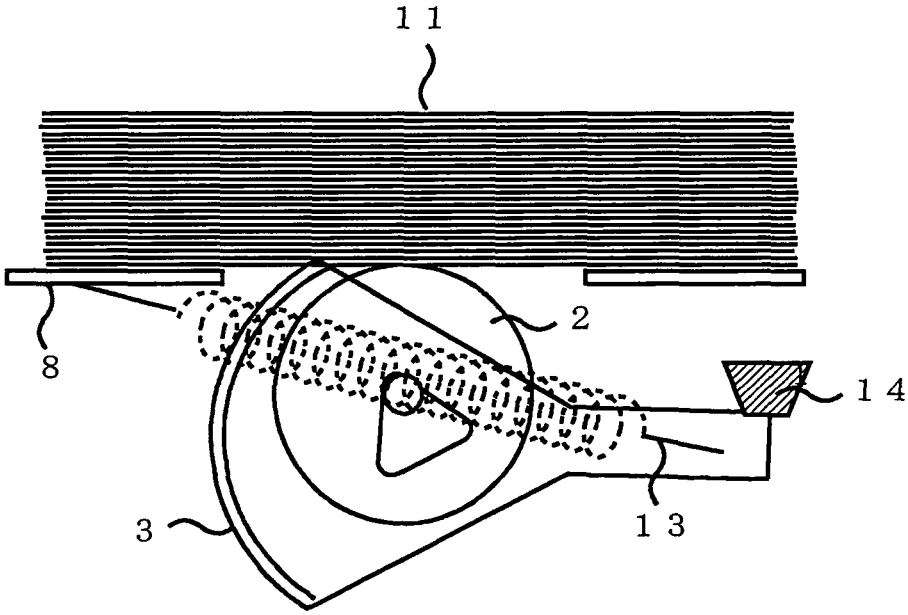
FIG. 4 is an explanatory view showing a state in which the shutter is open.

First Example of Shutter Opening and Closing Structure Using the Stacked Weight FIG. 3 and FIG. 4 are views of a first example of the shutter 3 seen from the side. FIG. 3 shows the shutter 3 in a closed state, and FIG. 4 shows the shutter 3 in an open state. The shutter 3 can be constituted by a portion which has an arcuate cross section and which is longer in the axial direction of the roller than the second pickup roller 2 and two side surface portions which support it on both side surfaces. Triangular engagement holes 31 are provided in the side surface portions of the shutter 3, and a roller shaft 21 of the second pickup roller 2 passes through them. The engagement holes 31 do not need to be triangular, and they can have other shapes, such as the oval shape shown in FIG. 5. A tension spring 13 has one end mounted on the paper support base 8 and the other end mounted on a portion (the arm portion) of a side surface portion of the shutter 3.

As shown in FIG. 3, when the amount of paper is small and supply of paper is being carried out only by the first pickup roller 1, due to the tension of the tension spring 13 mounted on the arm portion at the lower portion of the shutter 3, the shutter 3 is closed so as to establish a state in which paper does not contact the second pickup roller. As a result, when only a small amount of paper is stacked on the paper support base 8, there is no contact between the paper and the second pickup roller 2, so deformation of paper and paper misfeeds due to a difference in paper transportation amount between the first pickup roller 1 and the second pickup roller 2 are prevented.

When a large amount of paper is stacked on the paper support base 8, the shutter 3 assumes the open state shown in FIG. 4, the paper 11 and the second pickup roller 2 contact each other, and the paper transport force of the second pickup roller 2 can be utilized. As a result, even in a situation in which a large amount of paper is stacked and pickup cannot be performed by just the first pickup roller 1, pickup can be performed without problems by the first pickup roller 1 assisted by the transport force of the second pickup roller 2. This opening and closing of the shutter 3 can be performed such that the shutter 3 is opened when the weight of the paper stacked on the paper support base is at least a prescribed weight and the shutter 3 is closed when the weight of the stacked paper is less than or equal to a prescribed weight. In order to limit the range of movement of the shutter, a stopper 14 which is contacted by the arm portion of the shutter 3 is provided.

Second Example of an Opening and Closing Structure of the Shutter Using the Stacked Weight A second example of a shutter structure which opens and closes due to the weight of stacked paper will be explained while referring to FIGS. 5-7. FIG. 6 is an explanatory view of the structure of hooks respectively provided for the second pickup roller and for the shutter. The drive force of the drive shaft 17 for the second pickup roller is connected to the drive system for the first pickup roller 1 by a belt 19, and the first pickup roller 1 and the second pickup roller 2 rotate in synchrony.

The drive shaft 17 for the second pickup roller is connected not only to the second pickup roller (positioned inside the shutter 3 in the drawing) but also to a torque limiter 18. On the side surface portion of the shutter 3, a shutter hook 15 is provided on the side facing the torque limiter 18, while on the torque limiter 18, a roller drive system hook 16 is provided on the side facing the side surface portion of the shutter 3. As a result, the roller drive system hook 16 is linked to the drive shaft 17 for the second pickup roller through the torque limiter 18.

Figure 5A:
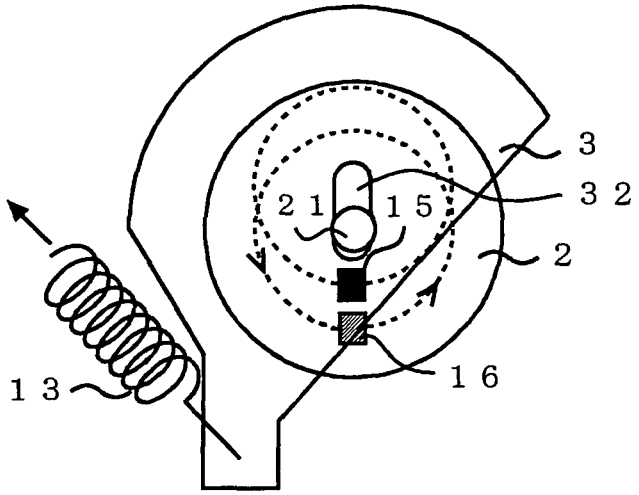
FIG. 5 is an explanatory view of a second example of a shutter structure which opens and closes under the weight of stacked paper.
Figure 6:
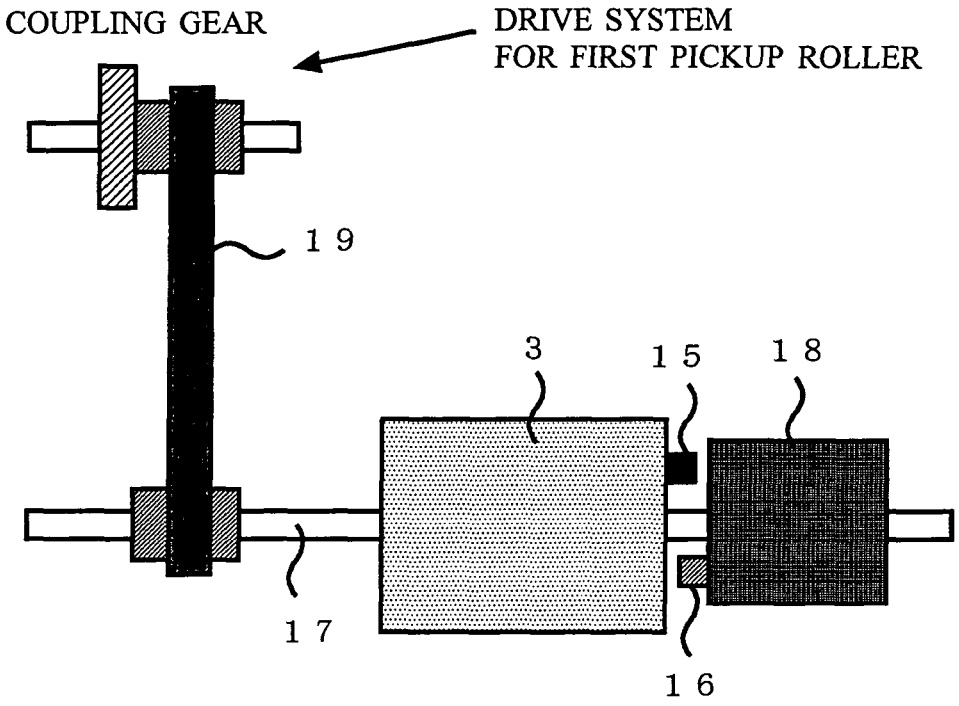
FIG. 6 is an explanatory view showing the structure of hooks provided for the second pickup roller and for the shutter, respectively.

As shown in FIG. 5(A), elongated narrow oval engagement holes 32 are provided in both side surface portions of the shutter 3, and a roller shaft 21 of the second pickup roller 2 passes through these engagement holes 32. When a load due to paper is not applied to the shutter 3, the shutter 3 itself is pulled upwards by the tension spring 13, and the shutter hook 15 is positioned higher than the rotational path of the roller drive system drive hook 16, so there is no engagement between the shutter hook 15 and the roller drive system hook 16, and the shutter 3 maintains a closed state.

Figure 5B:
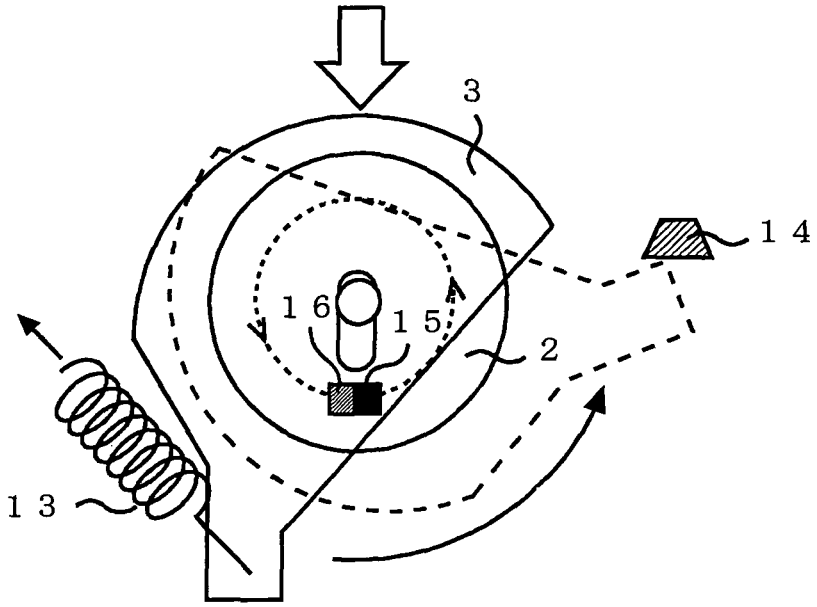

When a large amount of paper is stacked on the paper support base, the weight of the paper is applied to the shutter 3, and when this force exceeds the upwards pulling force of the tension spring 13, as shown in FIG. 5(B) the shutter 3 is pushed downwards, the rotational path of the shutter hook 15 and the rotational path of the roller drive system hook 16 coincide, and the shutter hook 15 and the roller drive system hook 16 engage, so the rotational drive force of the drive shaft of the second pickup roller 2 is transmitted to the shutter 3, and the shutter 3 rotates as shown by the dashed lines in FIG. 5(B) to open the shutter.

As the paper stacked on the paper support base is supplied and the amount of paper decreases, the force pushing the shutter 3 down weakens, the shutter 3 is pulled upwards by the tension spring 13, the shutter hook 15 and the roller drive system hook 16 separate, and the shutter 3 is closed. As shown in FIG. 6, the roller drive system hook 16 is linked to the drive shaft 17 for the second pickup roller through the torque limiter 18, so when the arm portion of the shutter 3 contacts the stopper 14 which is installed within the range of permissible movement of the shutter and stops, it performs idle rotation at or above a fixed torque.

Figure 7A:
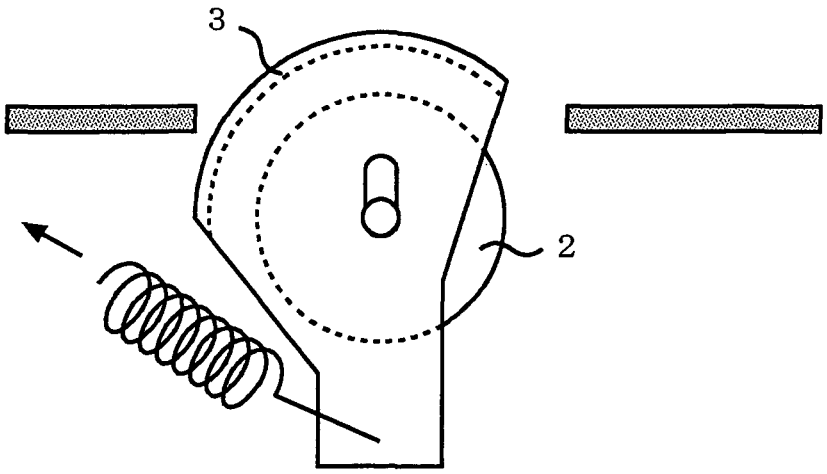
FIG. 7 is a view showing a third example of a shutter structure which operates under the weight of stacked paper.
Figure 7B:
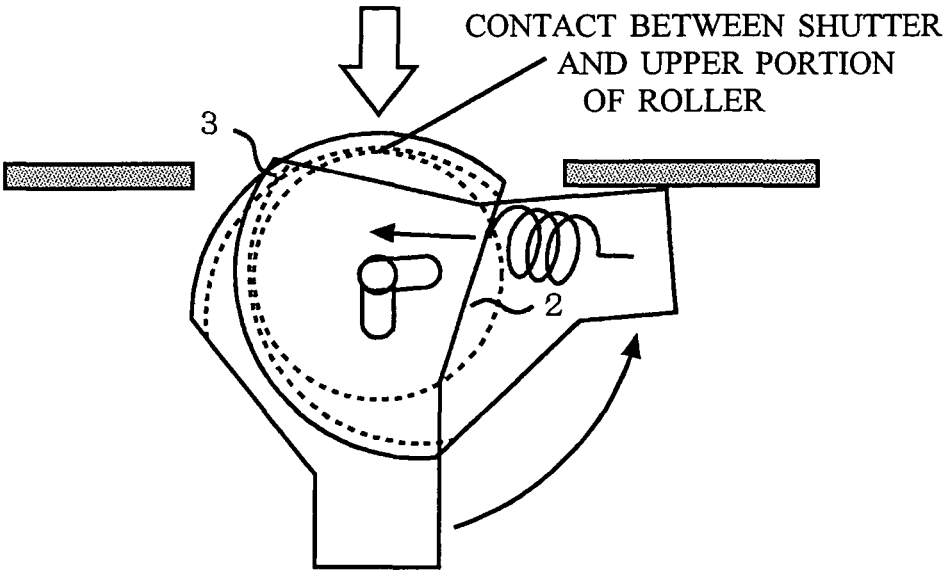

Third Example of an Opening and Closing Structure for the Shutter Using the Stacked Weight FIG. 7 is a view showing a third example of a shutter structure which relies on the stacked weight of paper. (A) shows a state in which a load is not applied to the shutter 3 by paper and the shutter 3 itself is pulled upwards by a tension spring. (B) shows a state in which a large amount of paper is stacked and the shutter 3 is open. As shown in the drawings, when a load is applied to the shutter 3, the shutter 3 is pushed downwards, the shutter 3 contacts the second pickup roller 2, and the shutter 3 rotates and opens due to the rotational force of the second pickup roller 2 utilizing the frictional force generated between the roller 2 and the shutter 3.

Figure 8A:
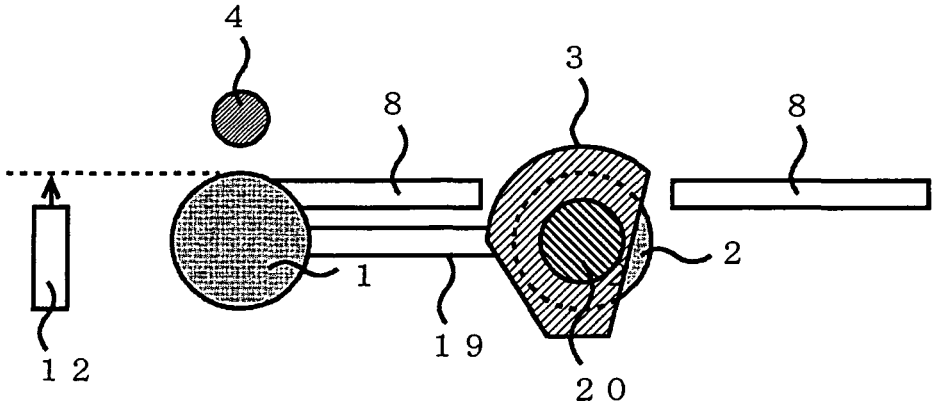
FIG. 8 is an explanatory view of shutter opening and closing operation on basis of pickup miss sensing.
Figure 8B:
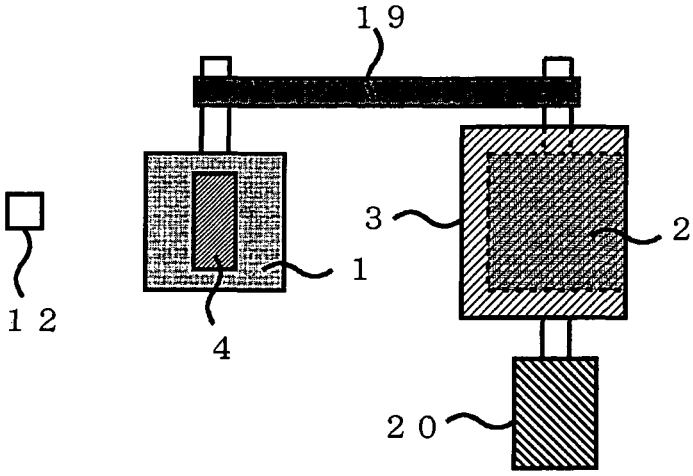
Figure 9:
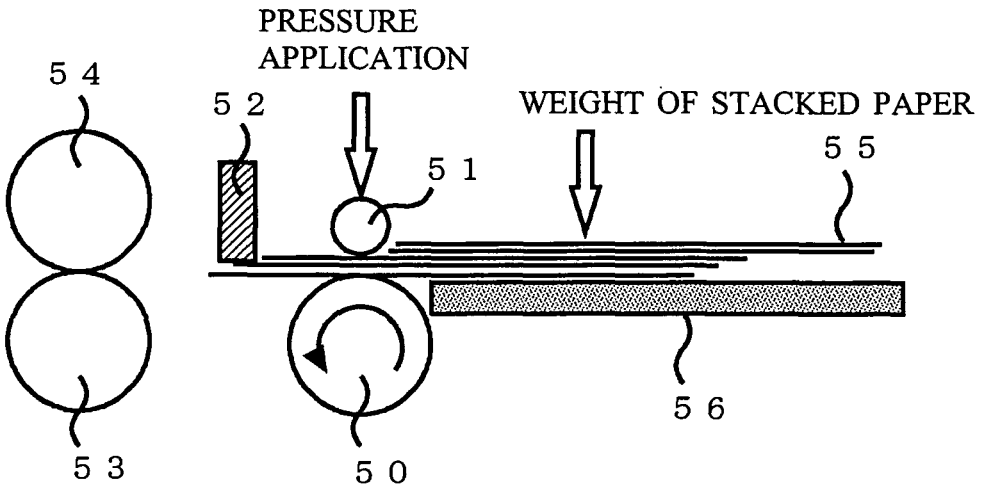
FIG. 9 PRIOR ART
FIG. 9 is a view showing the structure of a conventional paper supply apparatus.
Figure 10:
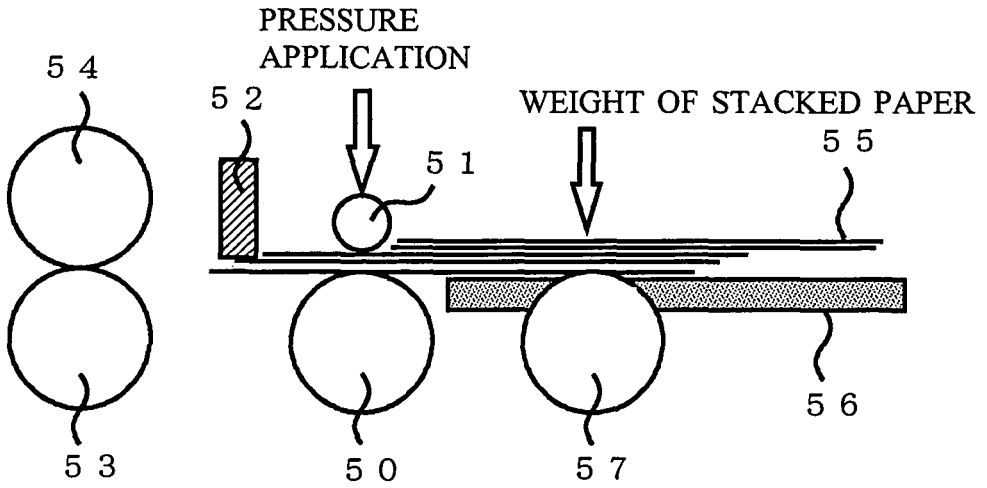
FIG. 10 PRIOR ART
FIG. 10 is a structural view of the case in which a second pickup roller is provided.
Figure 11A:
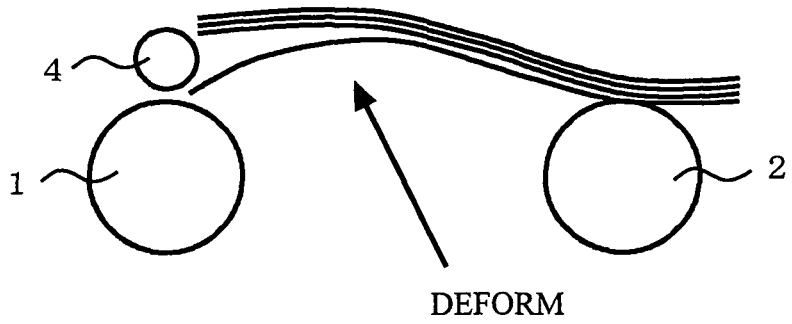
FIG. 11(A) PRIOR ART
FIG. 11 is an explanatory view of paper misfeeds by the second pickup roller.
Figure 11B:
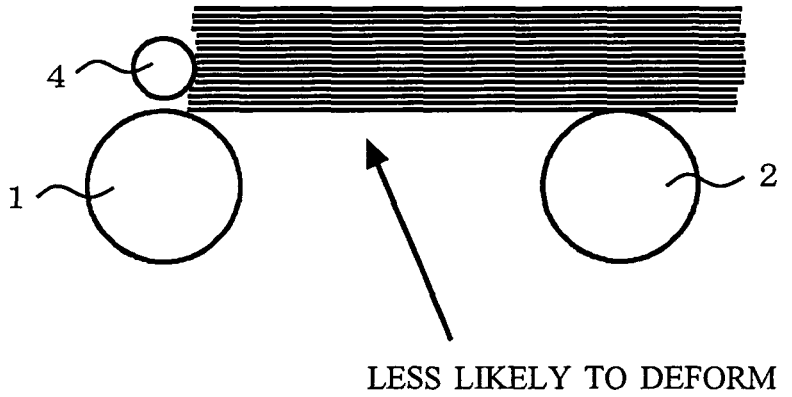
FIG. 11(B) PRIOR ART

Example of a Shutter Opening and Closing Structure Using Sensing of Pickup Misses FIG. 8 is a view showing a structure which senses pickup misses by the first pickup roller and carries out opening and closing of the shutter. (A) is a side view and (B) is a top view. As shown in the drawings, a paper transport sensor 12 is installed along a paper transport path. When the sensor 12 senses that paper is not being transported in a normal manner by pickup operation by only the first pickup roller 1, a shutter opening and closing stepping motor 20 provided for opening and closing of the shutter 3 is controlled to open the shutter 3, to thereby enable utilization of the paper transport force of the second pickup roller 2. Subsequently, when pickup operation is being carried out normally and the paper transport sensor 12 senses that paper transport is being carried out normally, the shutter opening and closing stepping motor 20 is controlled so as to close the shutter 3.

Opening and closing of the shutter 3 provided on the second pickup roller 2 is not limited to the above-described methods using the weight of the stacked paper or using detection of a pickup miss by just the first pickup roller. In addition, a mechanism for realization thereof is not limited to the above-described mechanisms, and it can be realized by other structures.

The invention claimed is:

1. A bottom removal-type paper supply apparatus, comprising:

a paper support base on which paper is stacked located at a bottom part of the bottom removal-type paper supply apparatus;

a first pickup roller provided at an end portion of the paper stacked on the paper support base, on a side toward a body of the bottom removal-type paper supply apparatus, and which picks a paper sheet from the paper stacked on the paper support base from the bottom and transports the paper sheet on a paper path;

a pressing roller which applies a pressure to the paper stacked on the paper support base towards the first roller, and which is provided at the end portion of the paper stacked on the paper support base;

a second pickup roller provided at a central portion of the paper stacked on the paper support base, and selectively assisting the first pickup roller to transport the paper sheet into the bottom removal-type paper supply apparatus; and a shutter switchable between an open state in which the paper is in contact with the second pickup roller enabling the second pickup roller to assist the first pickup roller to transport the paper on the paper path, and a closed state in which the shutter prevents the contact between the paper and the second pickup roller, the shutter being provided on the second pickup roller.

2. A bottom removal-type paper supply apparatus as set forth in claim 1, wherein the pressure applied to the paper by the pressing roller is adjustable.

3. The bottom removal-type paper supply apparatus as set forth in claim 2, wherein the pressure applied to the paper by the pressing roller is increased in steps when the first pickup roller fails to transport the paper on the paper path.

4. A bottom removal-type paper supply apparatus as set forth in claim 1, further comprising a mechanical assembly to switch the shutter to the open state from the closed state when the weight of the paper stacked on the paper support base exceeds an elastic force of a spring included in the mechanical assembly.

5. A bottom removal-type paper supply apparatus as set forth in claim 1, further comprising a sensor located along the paper path, to sense when the first pickup roller fails to transport the paper on the paper path while the shutter is in the closed state, and to send a control signal to switch the shutter in the open state the shutter being controlled to be in the open state when a failure of the first pickup roller to transport the paper on the paper path has occurred, and to be in the closed state while the first pickup roller successfully transports the paper on the paper path through the apparatus.

6. The bottom removal-type paper supply apparatus as set forth in claim 1, wherein the shutter and the second pick-up roller have a common axis, and the shutter has at least one first portion that has an arcuate cross section, which extends to a larger distance from the common axis than the pickup roller, and at least one second portion, which extends to a smaller distance from the common axis than the pickup roller, and the at least one first portion is in contact with the paper stacked on the paper support base when the shutter is closed.

7. A paper supplying device supplying one sheet of paper at a time in an image processing apparatus, comprising:

a first pickup roller, located at an end portion of a paper stack, to pick a paper sheet from the paper stack, and to transport the paper sheet into the paper supply apparatus;

a second pickup roller, located at a central portion of the paper stack, to assist the first pickup roller to transport the sheet of paper into the paper supply apparatus when the paper stack weighs more than a prescribed weight; and a shutter to prevent contact between the second pickup roller and the paper stack while the paper stack weights less than the prescribed weight.

* * * * *

UNITED STATES PATENT AND TRADEMARK OFFICE

CERTIFICATE OF CORRECTION

PATENT NO. : 8,636,279 B2
APPLICATION NO. : 10/575230
DATED : January 28, 2014
INVENTOR(S) : Suzuki et al.

It is certified that error appears in the above-identified patent and that said Letters Patent is hereby corrected as shown below:

In the Claims

Column 10, Line 9, In Claim 5, delete “state” and insert -- state, --, therefor.

Signed and Sealed this
Twenty-second Day of July, 2014

Michelle K. Lee

Michelle K. Lee
*Deputy Director of the United States Patent and Trademark Office*